US008973767B1

(12) United States Patent
Stearns et al.

(10) Patent No.: US 8,973,767 B1
(45) Date of Patent: Mar. 10, 2015

(54) INDOOR FIREWOOD RACK

(71) Applicants: Jeffrey Stearns, Hopatcong, NJ (US); David S Trandal, Santa Barbara, CA (US)

(72) Inventors: Jeffrey Stearns, Hopatcong, NJ (US); David S Trandal, Santa Barbara, CA (US)

( * ) Notice: Subject to any disclaimer, the term of this patent is extended or adjusted under 35 U.S.C. 154(b) by 0 days.

(21) Appl. No.: 13/789,348

(22) Filed: Mar. 7, 2013

(51) Int. Cl.

| | |
|---|---|
| ***A47F 1/04*** | (2006.01) |
| ***A47F 5/00*** | (2006.01) |
| ***A47F 5/08*** | (2006.01) |
| ***A47F 7/00*** | (2006.01) |
| ***A47B 81/00*** | (2006.01) |
| ***A01M 29/00*** | (2011.01) |
| ***A47B 47/00*** | (2006.01) |
| ***A47B 47/02*** | (2006.01) |
| ***A47B 55/00*** | (2006.01) |

(52) U.S. Cl.

CPC ..... *A47B 81/00* (2013.01); *A01M 29/00* (2013.01); *A47B 47/00* (2013.01); *A47B 47/028* (2013.01); *A47F 7/0021* (2013.01); *A47B 55/00* (2013.01)

USPC ..... 211/87.01; 211/134; 211/60.1

(58) Field of Classification Search

CPC ..... A47F 5/08; A47F 5/0807; A47F 3/06; A47F 3/063; A47F 5/0018; A47F 5/0031; A47F 5/13; A47F 7/00; A47F 7/007; A47F 7/0014; A47F 7/0021; A47F 7/16; A47F 7/17; A47B 47/027; A47B 47/0025; A47B 47/0041; A47B 47/021; A47B 47/028; A47B 55/00; A47B 81/00; A47B 47/00

USPC ..... 211/74, 182, 49.1, 189, 134, 135, 60.1, 211/34, 36, 87.01, 186, 44; 312/257.1, 351, 312/321; 220/572

See application file for complete search history.

(56) References Cited

U.S. PATENT DOCUMENTS

| | | | | |
|---|---|---|---|---|
| 1,700,212 | A * | 1/1929 | Arlt | 211/85.17 |
| 2,008,748 | A * | 7/1935 | Crow | 211/34 |
| 2,152,192 | A * | 3/1939 | Hoffman | 211/34 |
| 2,622,741 | A * | 12/1952 | Bamert | 211/74 |
| 4,245,746 | A * | 1/1981 | Aylor | 211/40 |
| 4,282,977 | A * | 8/1981 | Di Lorenzo | 211/74 |
| 4,378,070 | A * | 3/1983 | Matheis | 211/119.004 |
| 4,836,391 | A * | 6/1989 | Bell | 211/60.1 |
| D313,130 | S * | 12/1990 | Staton | D6/414 |
| D314,111 | S * | 1/1991 | Ohno | D6/552 |
| D317,836 | S * | 7/1991 | Staton | D6/415 |
| 5,101,738 | A * | 4/1992 | Sideris | 108/94 |
| 5,169,009 | A * | 12/1992 | Bomze | 211/74 |
| 5,518,127 | A * | 5/1996 | Warmack et al. | 211/193 |
| 5,579,930 | A * | 12/1996 | Brendle | 211/151 |
| 6,000,389 | A * | 12/1999 | Alpert | 126/25 R |
| 6,006,744 | A * | 12/1999 | Taylor | 126/543 |
| 6,290,073 | B1 | 9/2001 | Barnes, Sr. et al. | |
| 6,364,129 | B1 * | 4/2002 | Dardashti et al. | 211/40 |
| 6,729,481 | B1 * | 5/2004 | O'Brien | 211/74 |
| 6,766,730 | B2 * | 7/2004 | Wrenn | 99/345 |
| 6,786,337 | B2 * | 9/2004 | Klein et al. | 211/34 |
| 6,991,118 | B2 * | 1/2006 | Phillips | 211/85.3 |
| 6,997,332 | B1 * | 2/2006 | Alexander et al. | 211/60.1 |
| 7,131,547 | B2 * | 11/2006 | Gawel | 211/183 |
| 7,188,873 | B2 * | 3/2007 | Brown et al. | 292/336.3 |
| 7,766,174 | B2 * | 8/2010 | Abraitis | 211/36 |
| 8,096,430 | B2 * | 1/2012 | Lim | 211/195 |
| 8,113,608 | B2 | 2/2012 | Tassin et al. | |
| 8,133,049 | B1 * | 3/2012 | Sullivan et al. | 432/258 |
| 8,276,769 | B2 * | 10/2012 | Hogeback | 211/74 |

(Continued)

*Primary Examiner* — Jennifer E Novosad

(57) ABSTRACT

A sturdy, wall mounted indoor firewood rack which includes a detachable tray capable of catching and retaining dirt, wood chips, residue, snow, and water.

12 Claims, 12 Drawing Sheets

(56) References Cited

U.S. PATENT DOCUMENTS

| | | | | |
|---|---|---|---|---|
| 8,522,987 | B2 * | 9/2013 | Lim | 211/134 |
| 2002/0162814 | A1 * | 11/2002 | Gawel | 211/183 |
| 2005/0205499 | A1 * | 9/2005 | Botner | 211/34 |
| 2008/0179329 | A1 * | 7/2008 | Brooks et al. | 220/495.06 |
| 2009/0039747 | A1 * | 2/2009 | Webster et al. | 312/334.1 |
| 2011/0204005 | A1 * | 8/2011 | Freitas | 211/4 |
| 2013/0095162 | A1 * | 4/2013 | Quinn | 424/409 |
| 2013/0146602 | A1 * | 6/2013 | Lessard et al. | 220/495.04 |

* cited by examiner

Example Embodiment
of Indoor Fire Rack

INDOOR FIREWOOD RACK

CROSS REFERENCE TO RELATED APPLICATIONS

Not applicable.

STATEMENT REGARDING FEDERALLY SPONSORED R&D

Not applicable.

PARTIES OF JOINT RESEARCH AGREEMENT

Not applicable.

REFERENCE TO SEQUENCE LISTING, TABLE, OR COMPUTER PROGRAM LISTING

Not applicable.

FIELD OF THE INVENTION

The present invention relates generally to commercial and residential permanently affixed holding racks. More specifically, the invention is an indoor, wall mounted, load supporting, platform for firewood which includes a mechanism for collecting and dispensing firewood particulate matter.

BACKGROUND OF THE INVENTION

Firewood storage generally is associated with insects, rodents and other pests which utilize the stored firewood as a food source, protection from the weather, their home, breeding, etc. Homeowners (and/or commercial properties) generally store their firewood outdoors, usually at a location on their property geographically separate from their home in order to keep the pests from damaging their home. Disadvantageously, storing firewood outside and remote from a user's home creates a number of problems including, for examples: increased pest infestation, cold, wet firewood, and burdensome access, particularly on inclement weather days. All factors which discourage fireplace use.

SUMMARY OF THE INVENTION

Example embodiments listed promote and enable the storage of firewood indoors by providing a storage rack which is easy to install, is visually aesthetic, contains firewood dirt and debris, and provides a degree of pest control.

An example embodiment provides an indoor firewood rack comprising: a left side panel structure; a right side panel structure; a back panel structure wherein the back panel structure is mated to the left side panel structure and right side panel structure, wherein the left side panel structure, the right side panel structure, and the back panel structure form an enclosure; a plurality of tubular bars interfacing with said left side panel structure and said right side panel structure to form one or more firewood rack shelves wherein the firewood rack shelves provide, at least in part, structural support of said firewood rack; and a detachable tray affixed to the bottom of the enclosure; and wherein the detachable tray edges include an upturned edge; and optionally, wherein the detachable tray is not a structural support element of said rack; and optionally, wherein the detachable tray is a standard baking sheet; and optionally, wherein the detachable tray is affixed to the enclosure with a front-to-back pitch; and optionally, wherein the plurality of tubular bars interface with the right side panel structure and the left side panel structure using one or more star nuts; and optionally, wherein the back panel comprises a transparent material; and optionally, the indoor firewood rack further comprising: one or more detachable liners affixed to the (a) right side panel structure, (b) the left side panel structure, (c) the back panel structure, or any combination of (a), (b), and (c); and optionally, wherein the one or more detachable liners comprises, at least in part, an insect repellent; and optionally, the indoor firewood rack further comprising: a wall mount accessory wherein a one or more components of the wall mount accessory are affixed to the back panel structure; and optionally, the indoor firewood rack further comprising: a cover wherein the cover is releasably securable to the front and top of the enclosure; and optionally, wherein the left side panel structure, the right side panel structure, and the back panel structure comprises, at least in part, wood; and optionally, wherein at least one or more of the tubular bars comprises, at least in part, light-weight aluminum.

An example embodiment provides an indoor firewood rack comprising: a left side panel structure; a right side panel structure; a back panel structure wherein the back panel structure is mated to the left side panel structure and right side panel structure, wherein the left side panel structure, the right side panel structure, and the back panel structure form an enclosure; a plurality of tubular bars interfacing with said left side panel structure and said right side panel structure to form one or more firewood rack shelves wherein the firewood rack shelves provide, at least in part, structural support of said firewood rack; and a fixture to enable a detachable tray; and optionally, wherein the plurality of tubular bars interface with the right side panel structure and the left side panel structure using one or more star nuts; and optionally, wherein the back panel comprises a transparent material; and optionally, the indoor firewood rack further comprising: one or more detachable liners affixed to the (a) right side panel structure, (b) the left side panel structure, (c) the back panel structure, or any combination of (a), (b), and (c); and optionally, wherein the one or more detachable liners comprises, at least in part, an insect repellent; and optionally, the indoor firewood rack further comprising: a wall mount accessory wherein a one or more components of the wall mount accessory are affixed to the back panel structure; and optionally, the indoor firewood rack further comprising: a cover wherein the cover is releasably securable to the front and top of the enclosure; and optionally, wherein the left side panel structure, the right side panel structure, and the back panel structure comprises, at least in part, wood; and optionally, wherein at least one or more of the tubular bars comprises, at least in part, light-weight aluminum.

An example embodiment provides an indoor firewood rack comprising: a left side panel structure; a right side panel structure; a first wall mount assembly wherein the first wall mount assembly is affixed to the left panel structure; a second wall mounting assembly wherein the second wall mount assembly is affixed to the left panel structure, wherein the first wall mount assembly and the second wall mount assembly enable wall attachment of said indoor firewood rack; a plurality of tubular bars interfacing with said left side panel structure and said right side panel structure to form one or more firewood rack shelves wherein the firewood rack shelves provide, at least in part, structural support of said indoor firewood rack; and a fixture to enable a detachable tray; and optionally, wherein the plurality of tubular bars interface with the right side panel structure and the left side panel structure using one or more star nuts; and optionally, the indoor firewood rack further comprising: one or more detachable liners affixed to the (a) right side panel structure, (b) the left side panel structure, or any combination of (a) and (b) and optionally, wherein the one or more detachable liners comprises, at least in part, an insect repellent; and optionally, the indoor firewood rack further comprising: a cover wherein the cover is releasably securable to the front and top of the enclosure; and optionally, wherein the left side panel structure and the right side panel structure comprises, at least in part, wood; and optionally, wherein at least one or more of the tubular bars comprises, at least in part, light-weight aluminum.

BRIEF DESCRIPTION OF THE DRAWINGS

Example embodiments will now be described with reference to the drawings summarized below. These drawings and the associated descriptions are provided to illustrate example embodiments of the invention, and not to limit the scope of the invention.

DETAILED DESCRIPTION OF THE PRESENT INVENTION

Embodiments of an indoor fire rack are provided whereby an enclosure with tubular crossbars and a sliding tray hold a plurality of logs or other pieces of firewood. Optionally, the indoor fire rack described in this specification includes means to control pests which may be present on or within the firewood. Optionally, the cabinet is configured to be mounted to a wall, for example, a wall adjoining a fireplace for convenient access to the firewood.

Enclosure

Figure 1:
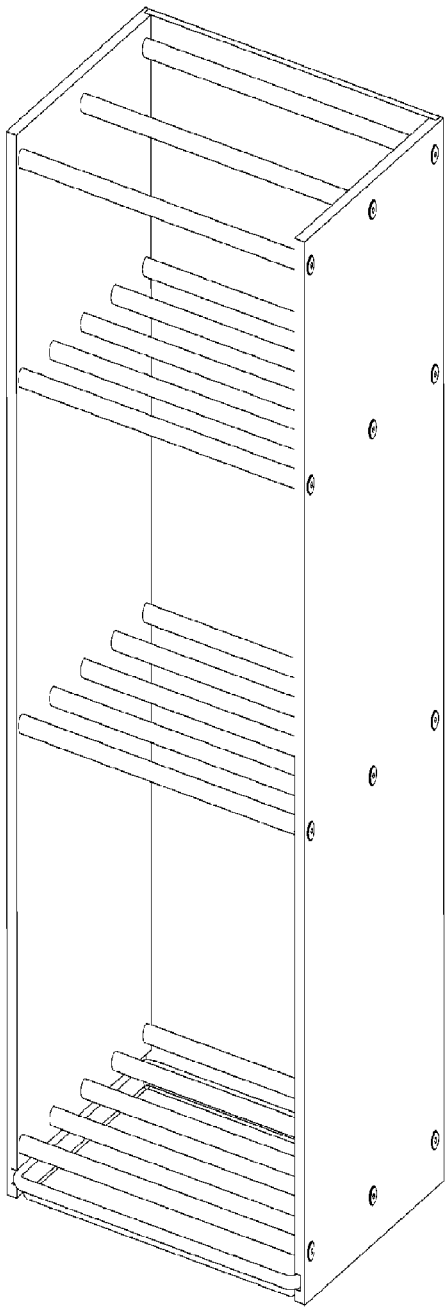
FIG. 1 depicts an example embodiment of an inventive indoor firewood rack assembly.
Figure 2:
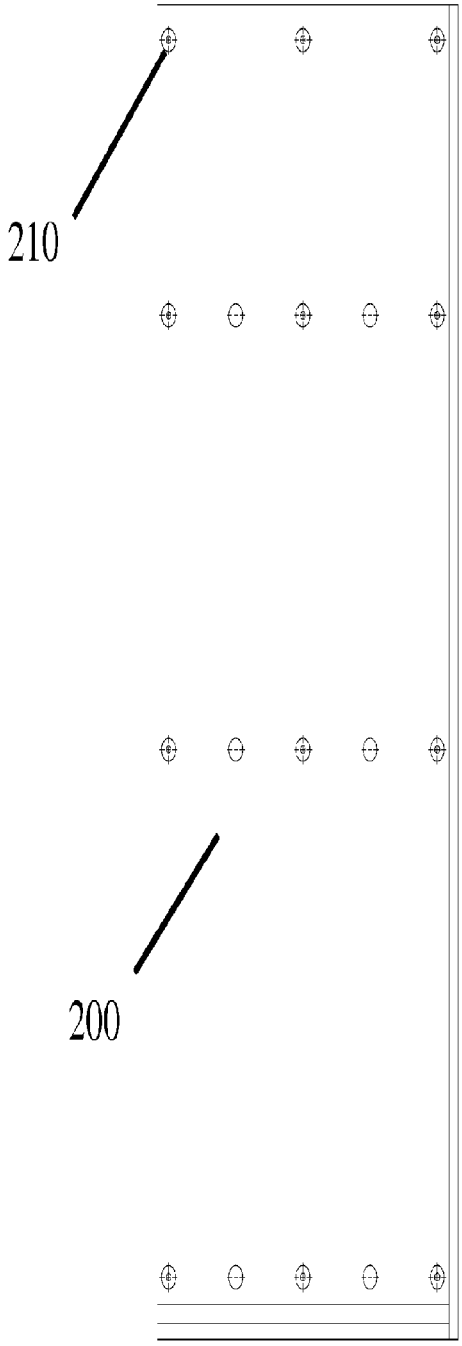
FIG. 2 depicts an example embodiment of an inside view of a side panel of an indoor firewood rack assembly.
Figure 3:
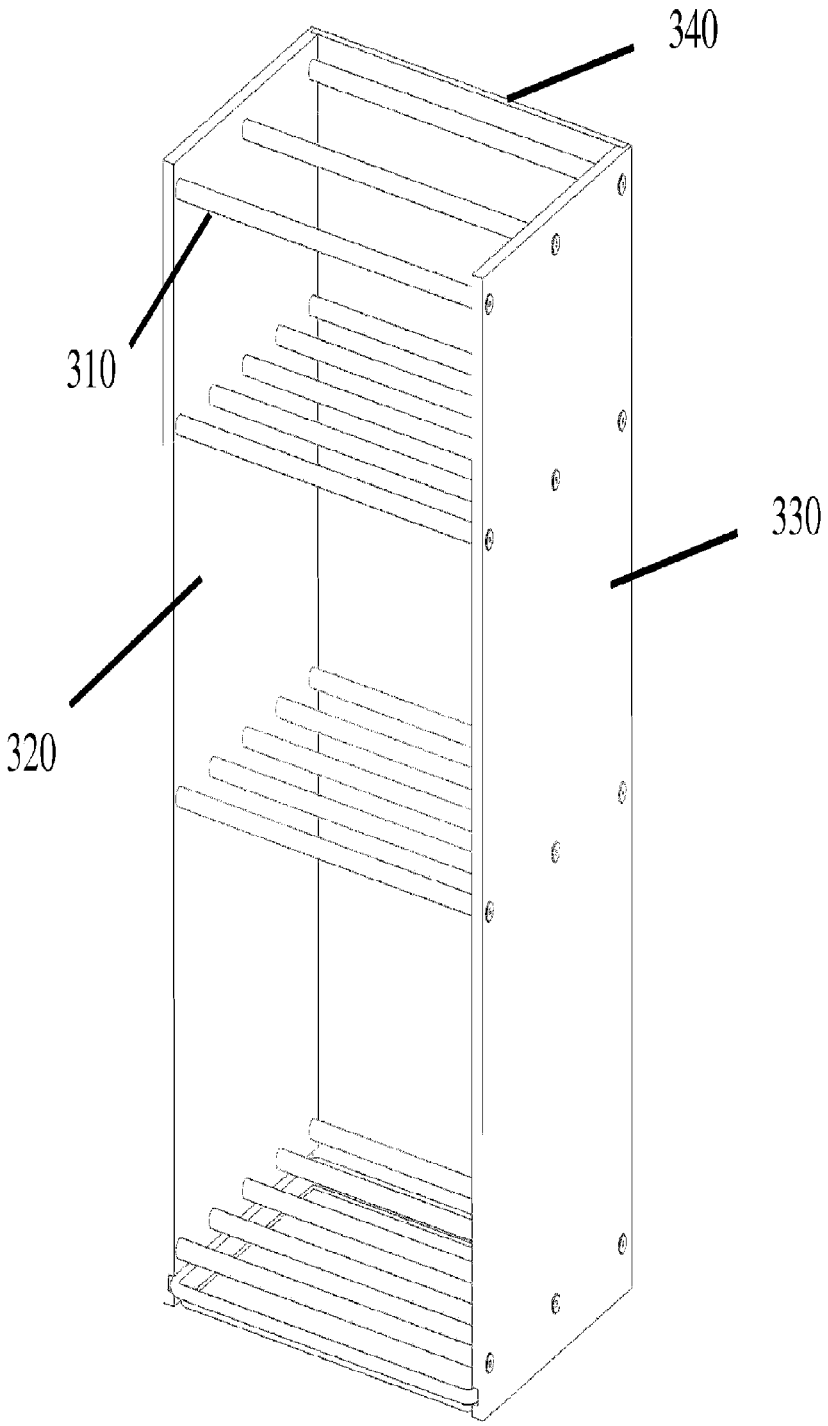
FIG. 3 depicts an example embodiment of a partially assembled indoor firewood rack assembly including side panels, back panel, and cross bars.

FIG. 1 illustrates an example embodiment of the indoor fire rack of the present invention. The enclosure comprises a pair of side panels and a back panel. Each side panel 200 includes one or more inner counterbores 210 used to mate horizontally with one or more tubular crossbars 310, see also FIG. 2 and FIG. 3. Two or more tubular crossbars 310 form a firewood rack shelf joined to the left panel 320 at one end of the tubular bar 310 and joined at the right panel 330 at the other end, see FIG. 3. Optionally, the enclosure includes one shelf of tubular bars, two shelves of tubular bars, three shelves of tubular bars, or more. Optionally, the back panel 340 is affixed perpendicular to the two side panels 320, 330 as illustrated in FIG. 3. Optionally, the indoor fire wood rack includes a top panel (not shown in Figures) which is either affixed to the two side panels 320, 330 and back panel 340 and/or seats on the set of tubular bars 310, for example, the three tubular bars illustrated in FIG. 3. Optionally, the top panel includes one or more half-radius (e.g., matching the outside radius of the tubular bars), routed grooves cut into the underside of the top panel to enable a user-friendly placement and neat and secure fit of the top panel to the enclosure. Optionally, decorative items/knick-knacks are placed on top of the top panel. Optionally, the top panel is manufactured from wood and/or other materials further described below with respect to the side and/or back panel.

Optionally, the indoor firewood rack enclosure is modular and can accommodate multiple tubular crossbar racks. Optionally, the indoor firewood rack includes three crossbar racks (see FIG. 3) and accommodates approximately ¼ cord of wood. Optionally, a four crossbar indoor firewood racks accommodates approximately $3/8^{th}$ a cord of wood. Optionally, a dual crossbar indoor firewood racks accommodates approximately $1/8^{th}$ a cord of wood.

Enclosure Connections/Assembly

Figure 5:
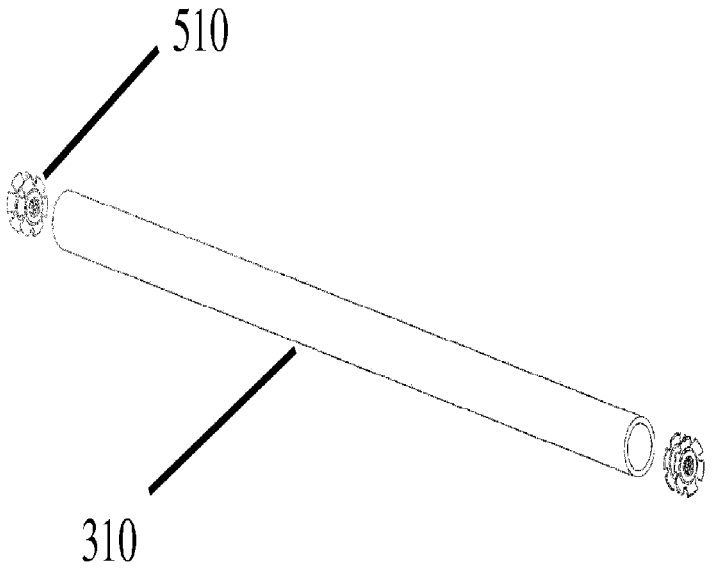
FIG. 5 depicts an example embodiment of tubular crossbars of an indoor firewood rack assembly.
Figure 6:
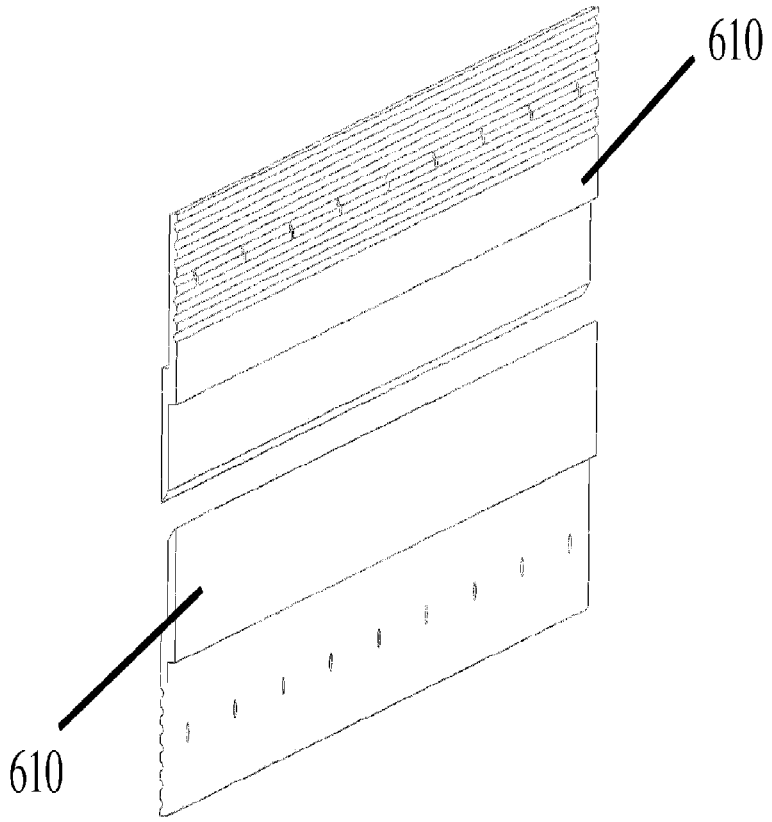
FIG. 6 depicts an example embodiment of interlocking hangers used to wall mount an indoor firewood rack assembly.

A key structural element of the fire rack is the tubular crossbars 310. As described above, the two or more tubular crossbars are inserted into a counterbore in the side of the side panel. The diameter of the counterbore closely approximates the outside diameter of the tubular crossbar allowing for a tight fit when the crossbar is inserted into the counterbore. The depth of the counterbore is variable. In an example embodiment, the depth of the notch is ½ the width of the side panel. Optionally, each circular counterbore includes a center hole drilled through the side panel. Optionally, the center hole accommodates a screw 410 which screws into the threaded receiving area at the end of the tubular crossbar. Optionally, the external end of the center hole is recessed to enable the head of screw to be flush with the side of the enclosure/side panel. Optionally, the cabinet is partially assembled by inserting a tubular crossbars into an inside panel slot, threading an appropriately sized screw 410 through the center hole and into one end of a tubular crossbar 310, and firmly attaching the crossbar to the side of the side panels 320,330. Optionally, appropriately sized star nuts 510 are pressed into each end of the tubular crossbars 310 as shown in FIG. 5. By sandwiching each side panel 320, 330 between machine screws 410 and tubular crossbars 310 with star nut inserts 510, the overall structure of the assembly can be tightened into a symmetrical balance of tension and compression forces. This results in a relatively lightweight but high strength structure which is ideal for holding large load while hanging on wall. Optionally, the second or more crossbars 310 are similarly attached with screws 410. Optionally, if more than two crossbars are configured in the enclosure, only the outside crossbars are screw mounted with the inner crossbars held in place by the inward force of the secured side panels and the sides of the slot. Those of ordinary skill in the art of mechanical construction recognize there are a number of methods which could be used to mount the crossbars 310 to the side panels 320, 330 including the use of adhesives such as glue, epoxy, etc., and/or a combination of mechanical fasteners and adhesives.

Optionally, the back panel 340 is bonded to the side panels using a strong adhesive. Those of ordinary skill in the art of mechanical construction recognize there are a number of methods which could be used to create a structurally sound bond between the side panels 320, 330 and the back panel 340 including a combination of mechanical fasteners and/or adhesives. Optionally, the back panel 340 is made with durable construction material and protects the homeowner's wall when the firewood is placed into the enclosure. Optionally, the back panel 340 is made with durable clear material such as polycarbonate and protects the homeowner's wall when the firewood is placed into the enclosure while showing wall paint color through the clear panel.

Figure 4:
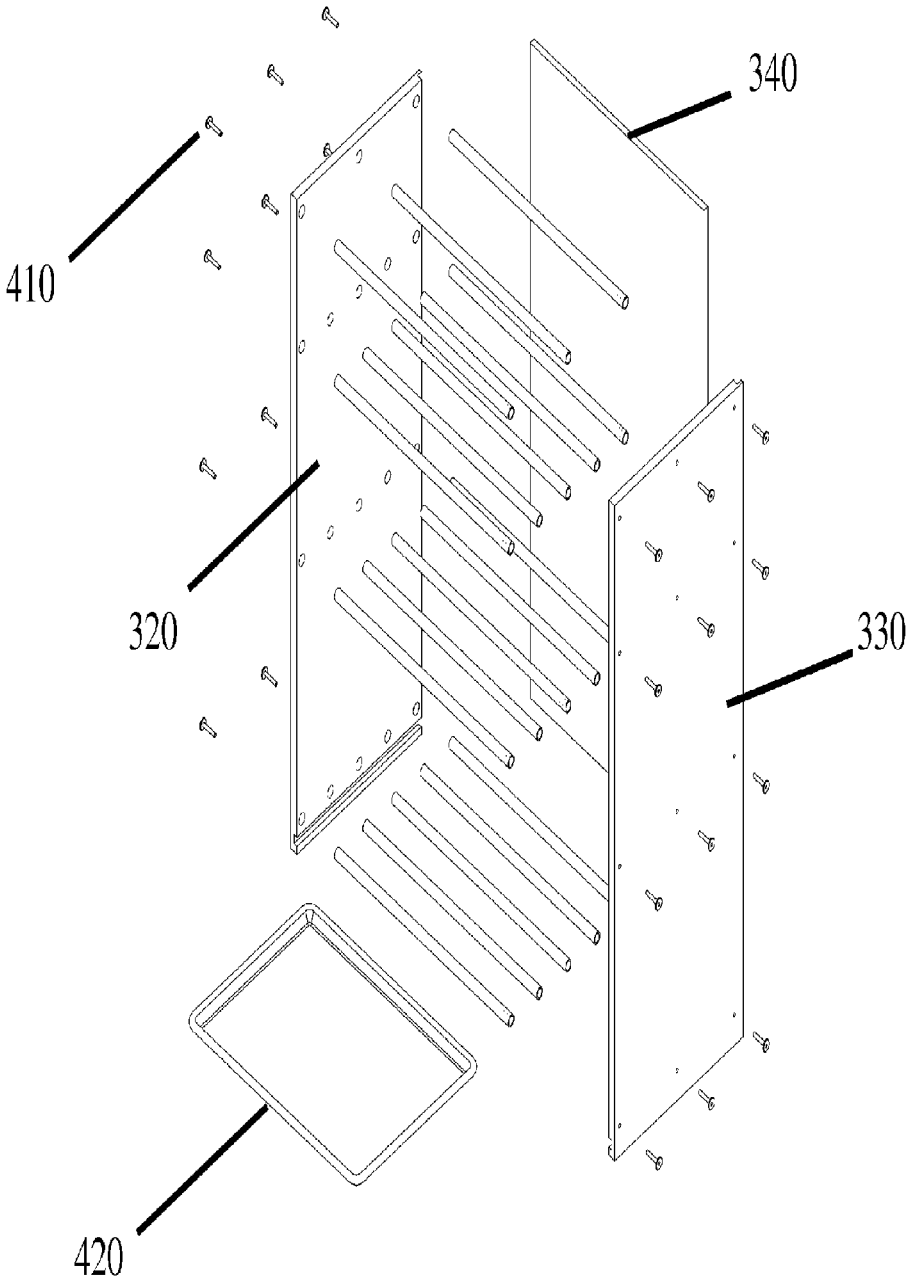
FIG. 4 depicts an example embodiment of an assembly diagram of an indoor firewood rack assembly.
Figure 11:
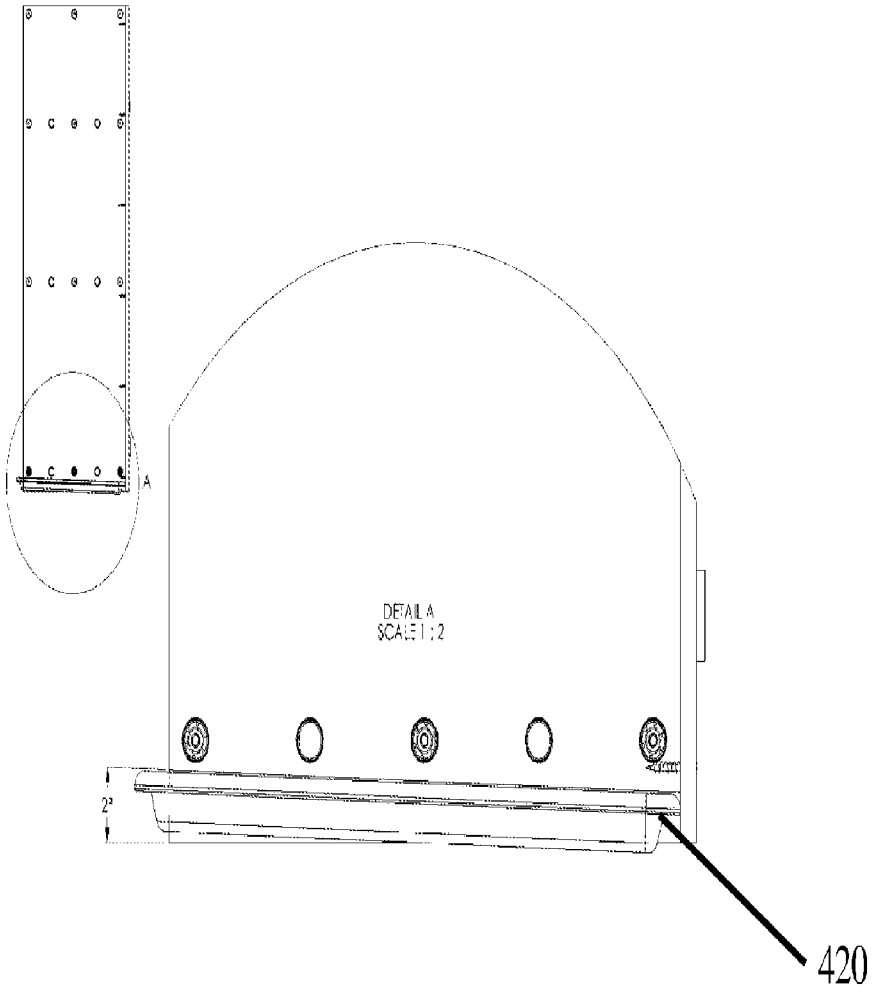
FIG. 11 depicts an example embodiment of a removable liner affixed to the right panel structure, the left panel structure, and the back panel structure.

Optionally, the bottom of the enclosure is enclosed using a detachable tray 420, see FIG. 4. Optionally, the tray 420 is sized proportionally to the width of the side panels 320, 330 and back panel 340. Optionally, the tray 420 has upturned edges or a lip (e.g., a 1 inch lip) so as to catch and retain dirt, chips, residue, snow and water that may be carried in with the logs set upon the tubular crossbar shelves. Optionally, the tray 420 catches pests which may exit the firewood. Optionally, the tray 420 has a small depression lining the inside of the tray 420 which is capable of retaining liquid pesticides as further described below. Optionally, the lining depression is deeper (e.g., by 15%) at the back of the tray 420 and thus capable of holding a larger amount of debris and/or liquid. Optionally, the tray 420 is configured in the enclosure with a slight pitch front-to-back (e.g., 5 degrees) such that any liquids and/or associated debris deposited on the tray 420 will migrate towards the back of the tray 420 as illustrated in FIG. 11. Optionally, the tray 420 easily slides in and out for easy cleaning. Optionally, the tray 420 is detachable for more extensive user cleaning and/or for application of pesticides/repellant fluids and/or liners as described below. Optionally, the tray 420 is a standard full size cookie sheet pan (e.g., dimensions 26 inches×18 inches), half-sheet cookie sheet pan (e.g., dimensions 18 inches×13 inches), or a quarter-sheet cookie sheet pan (e.g., dimensions 9 inches×13 inches). Advantageously and optionally, the tray 420 is provided by the user. Optionally, the tray 420 can be locked in fixed position using one or more latches. Optionally, the tray 420 can be locked in fixed position using one or more détentes. Optionally, there are two or more lengths of aluminum C-channel mounted to the bottom face of the side panels which secure the tray to the bottom of the enclosure but allows easy sliding of the tray for removal/cleaning. Optionally, the fixtures include one or more rollers to further improve facilitate the sliding action of the tray. Optionally, a groove is routed into the right side panel and left side panel. Optionally, the lip of the tray slides into the groove reducing and/or eliminating the need for securing fixtures and reducing the cost. Optionally, the tray groove is configured with one or more rollers (not shown in the figure) to facilitate the sliding action of the tray.

Figure 8:
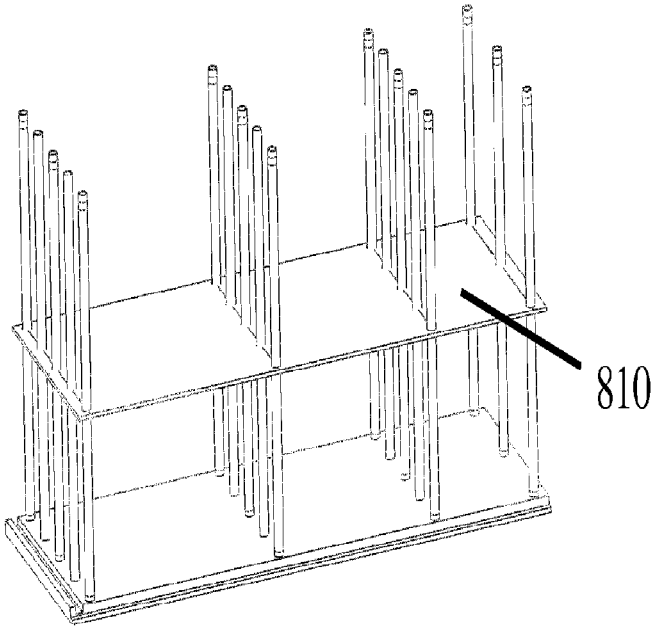
FIG. 8 depicts an example embodiment of optional jig used in the assembly of an indoor firewood rack.

Optionally, the indoor firewood rack is designed for user assembly. To facilitate user assembly, a bar holding jig 810 is included with the assembly, see also FIG. 8. The bar holding jig 810 is a temporary structural element that holds the one or more tubular bars in position as the user inserts the bars into the left side panel 320 and the right side panel 330 and secures the bars in place (e.g., using star nuts). Optionally, the bar holding jig 810 is constructed from a light-weight material (e.g., cardboard) and can be cut away after the side panels have been secured. Optionally, the bar holding jig 810 includes lines of partial perforation allowing the material to be easily torn away without tools after the side panels have been secured.

Enclosure Material

The indoor fire rack is constructed with high grade materials. Optionally, the side panels 320, 330, back panel 410, and top panel are manufactured using the same material, for example wood including plywood or Birch. Optionally, each panel is constructed with a different type of material, for example, side panels made from melamine and the back panel from medium-density fiberboard laminated to Formica. The types of construction material that can be used in the indoor firewood rack include but are not limited to: plastic, wood, steel, aluminum, carbon, polycarbonate, acrylic, fiberglass, Kevlar, structural foam, glass, melamine, silicone.

Figure 10:
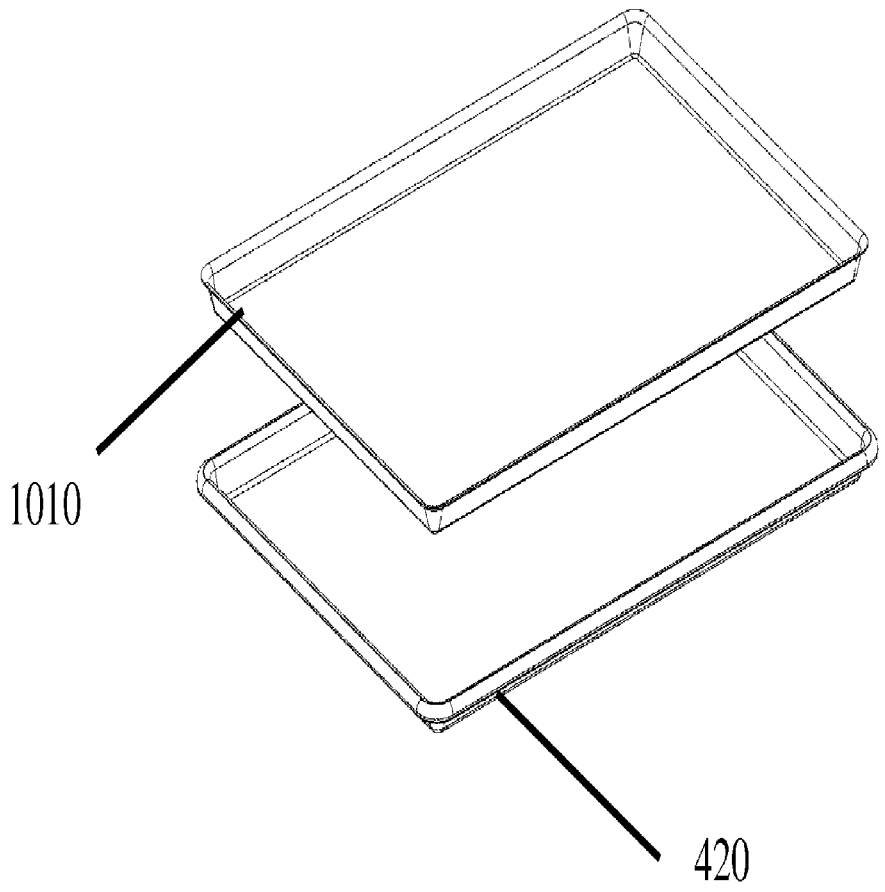
FIG. 10 depicts an example embodiment of a tray affixed to the bottom of the firewood rack enclosure in a front to back pitch.

Optionally, the enclosure is constructed with and/or treated with bug repellent materials. A feature of the indoor fire rack is the control of pests which may be present in the firewood. By using bug repellent construction material, the pests are not likely to exit the confines of the enclosure but rather maintain their presence within the firewood itself. For example, wood can be treated before assembly with a Borate preservative which is safe for consumer and does not contain copper or other heavy metals. A Borate preservative can be used as a repellent for termites, carpenter ants, etc. Optionally, the enclosure is made with naturally bug repellent material such as redwood. Optionally, the enclosure including the tray is internally lined with bug repellent material. For example, scented (e.g., citrus scented) drawer liners and/or their equivalent made from a fabric, paper, or plastic can be used on the interior of the enclosure. FIG. 10 illustrates an example embodiment of a tray liner 1010. Optionally, liners can be easily removed and/or replaced periodically. Optionally, the material used to construct the enclosure is made from or lined with materials with a very smooth surface. Optionally, all of the internal surfaces of the enclosure (including the tubular crossbars 310) are smooth preventing all or some of the pests from gaining a purchase outside of the firewood causing the pests to fall back onto the firewood or to the removable tray 420 at the bottom of the enclosure.

Optionally, the tray is made of stainless steel and/or light or heavy-gauge aluminum, plastic, wood, steel, carbon, polycarbonate, acrylic, fiberglass, Kevlar, structural foam, glass, melamine, silicone.

Optionally, a liquid pesticide, including for example an indoor safe pesticide including a citrus or Borate compound, is applied to the inner lining of the tray. Optionally, the liquid pesticide eliminates pests and/or reduces the likelihood of the pest exit from the enclosure. Optionally, the liquid pesticide is reapplied to the inner lining of the tray by a user on a periodic basis (e.g., weekly, monthly, semi-annual, etc.).

Optionally, a snap on front cover accessory is provided (not shown in Figures). Optionally, the front cover is optionally made of high-strength marine fabric and fits snugly to the front facing side panels of the enclosure. Optionally, the cover is made of other types of fabrics, leather, plastics, etc. Optionally, the cover snaps are placed on the front edges of the side panels. Optionally, the cover snaps are placed on the outer facing edges of the side panels. Optionally, the inside cover is pre-treated with pesticides/bug repellents. Optionally, the cover is treated with pesticides/bug repellents on a periodic basis (or depending upon the condition/quality of the wood). Optionally, the front cover accessory does not reach beyond the bottom front of the enclosure in order to allow the optional detachment of the tray. Optionally the front cover accessory reaches beyond the bottom front of the enclosure and mates with one or more snaps configured on the bottom of the sliding tray. Optionally, the tray snaps are configured at the front, middle, or back of the tray.

Figure 12:
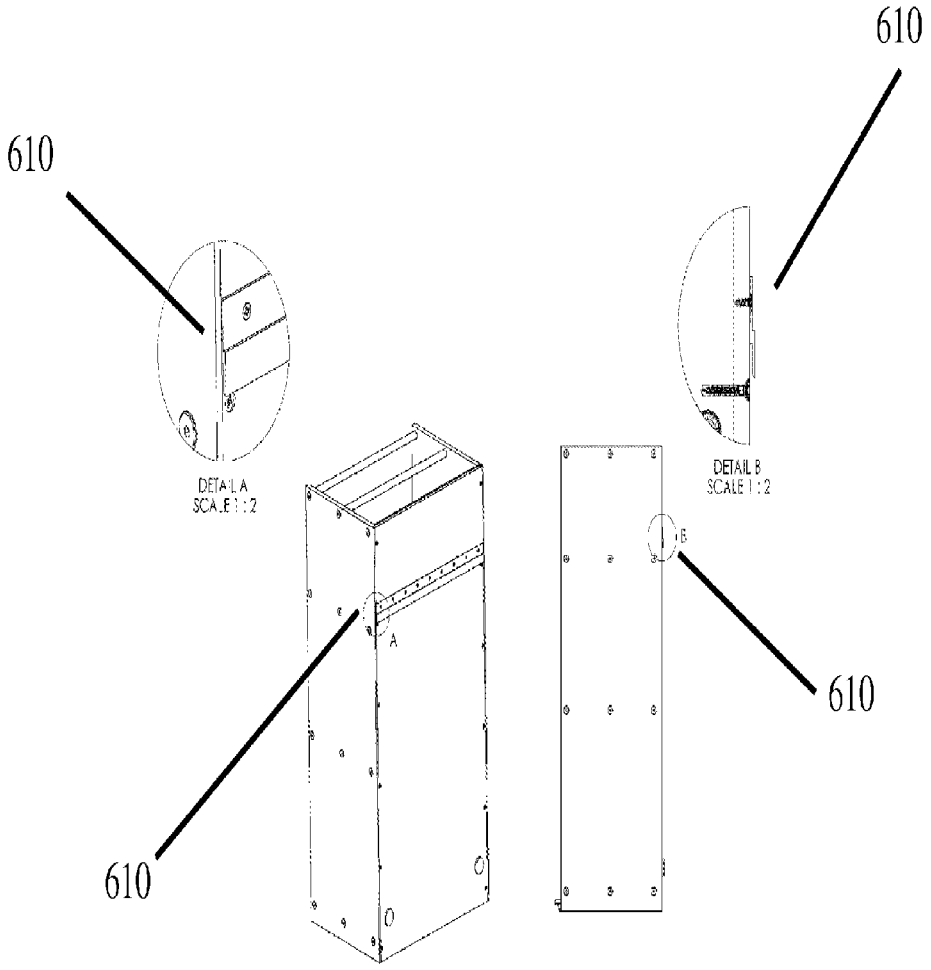
FIG. 12 depicts an example embodiment of a wall mount assembly affixed to the firewood rack back panel structure.

Optionally, the indoor fire rack is mounted to the wall. Optionally, the enclosure is mounted at a level which provides the user easy access to the firewood and slideable/detachable tray 420. Optionally, the enclosure is mounted with interlocking hangers 610 which slide together and interlock for a secure hold. For example, using interlocking hangers, a first hanger 610 is mounted to a wall stud. A second hanger 610 is inverted and mounted to the back panel 340 as illustrated in FIG. 12. The interlocking hangers are then slid together. Those of ordinary skill in the art of mechanical construction recognize there are a number of methods in addition to interlocking hangers which can be used to mount the enclosure to a wall including the use of wall mount screws, and/or adhesives, etc.

Figure 9:
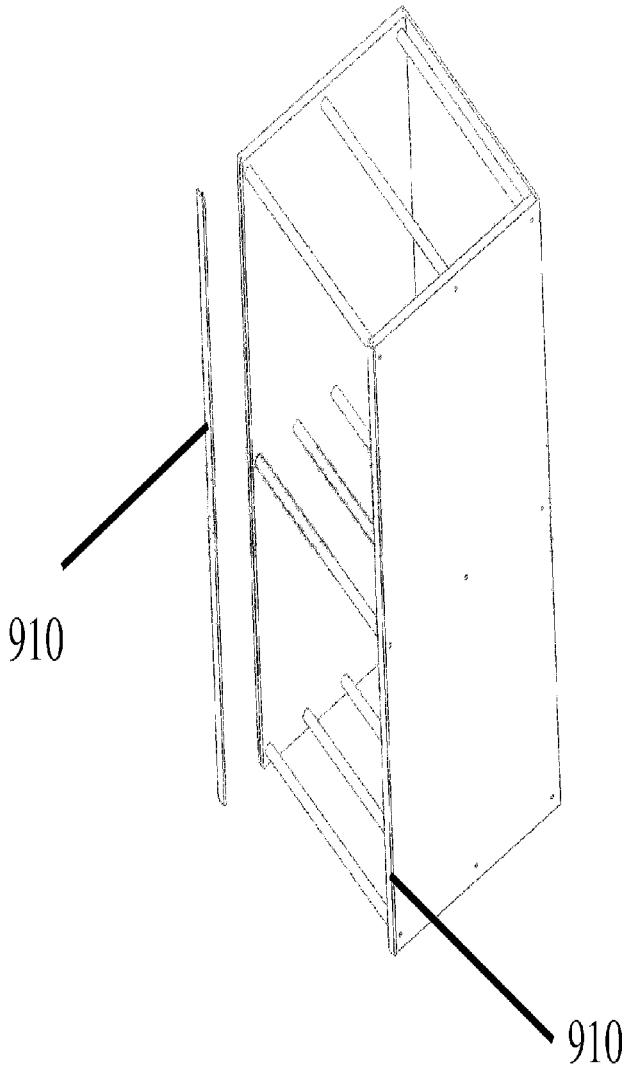
FIG. 9 depicts an example embodiment of external facing molding attached and attachable to the enclosure side panels.

The indoor fire rack is optionally fitted with a molding 910, for example, t-molding as illustrated in FIG. 9. Optionally, the molding is affixed to the side panels 320, 330 for example with an adhesive or attached with mechanical screws. Optionally, the molding is also affixed to the top panel. Optionally, the molding provides a decorative visual enhancement to the indoor firewood rack. Optionally, the molding provides a level of protection for the side and top panels as the user may hit the side panels when placing firewood within the enclosure. Optionally, the molding can be purchased and/or user installed as an accessory. Optionally, the molding is manufactured from plastic, stainless steel, and/or other materials as further described above with respect to the side and/or back panel.

Figure 7:
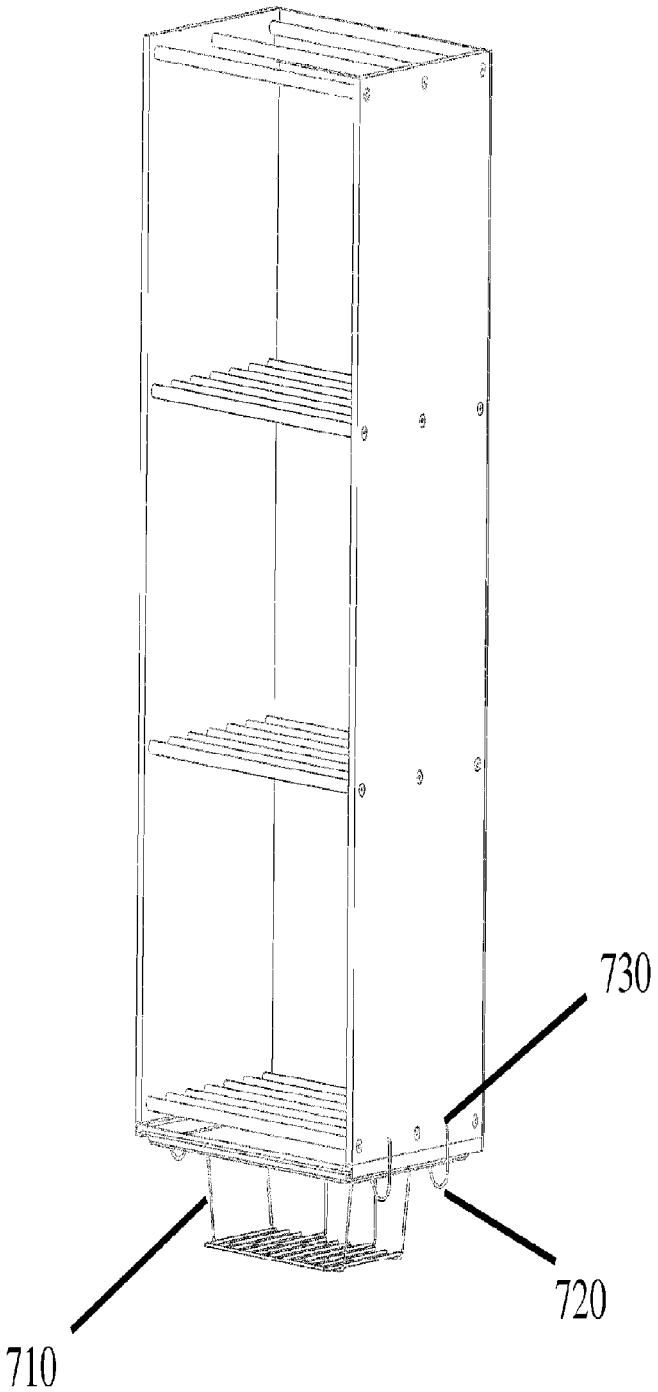
FIG. 7 depicts an example embodiment of an attachable accessory rack.

The indoor firewood rack optionally includes an attachable accessory rack 710 that is affixed and/or can be attached to either the tray or the left side panel 320 and the right side panel 330, see FIG. 7. Optionally, the attachable accessory rack can be used to store, for example, items which might be used in the fireplace (e.g., newspaper). Optionally, the attachable accessory rack 710 is a wire rack as illustrated in FIG. 7. Optionally, the attachable accessory rack includes wired siding and a solid framed bottom shelf. Optionally, the attachable accessory rack is purchased separately and user installable. Optionally, two or more flexible (e.g., can be bent outward 15 degrees) wire support hangers 720 (which can also serve as side panels of the accessory rack) are user inserted into one or more externally facing bored holes/sockets 730 at the bottom of the left side panel 320 and the right side panel 330. Optionally, the hanger is affixed with an adhesive and/or attached with one or more mechanical screws. Optionally, the attachable accessory rack is manufactured from plastic, stainless steel, and/or other materials as further described above with respect to the side and/or back panels. Optionally, the attachable rack is manufactured using a combination of materials. For example, the bottom shelf of the rack can be comprised of wood with the side and/or support hangers manufactured from aluminum or iron.

Exemplary Embodiment

An exemplary list of materials utilized in the present invention with dimensions is provided as follows in the following table:

TABLE 1

| QTY | ITEM | LENGTH | WIDTH | DEPTH | OUTSIDE DIAMETER | MATERIAL |
|---|---|---|---|---|---|---|
| 1 | Left Side Panel | 42" | 16¼" | ¾" | | Plywood |
| 1 | Right Side Panel | 42" | 16¼" | ¾" | | Plywood |
| 1 | Back Panel | 42" | 22" | ½" | | Plywood |
| 18 | Tube | 21¾" | | | ¾" | Aluminum |
| 24 | ¼-20 Star Nut | | | | ⅝" | Spring Steel |
| 24 | ¼-20 Knock Down Bolt | 1¼" | | | | Steel |
| 1 | Sheet Pan | 21¾" | 16" | 1¼" | | Aluminum |
| 2 | Wall Hanger | 21" | 2" | 3/16" | | Aluminum |
| 8 | #10 Wood Screw | 1½" | | | | Stainless Steel |
| 4 | #10 Wood Screw | ½" | | | | Stainless Steel |

In addition, it should be understood that certain variations and modifications of the systems and processes described herein would suggest themselves to one of ordinary skill in the art. The scope of the present invention is not to be limited by the illustrations or the foregoing descriptions thereof.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

What is claimed is:

1. An indoor firewood rack comprising:

a firewood rack left side panel structure;

a firewood rack right side panel structure;

a firewood rack back panel structure wherein the firewood rack back panel structure is mated to the firewood rack left side panel structure and the firewood rack right side panel structure and further wherein the back panel structure extends entirely from the top and bottom of the left side panel structure to the top and bottom of the right side panel structure, and further wherein the firewood rack left side panel structure, the firewood rack right side panel structure, and the firewood rack back panel structure form a firewood rack enclosure;

a plurality of tubular bars interfacing with said firewood rack left side panel structure and said firewood rack right side panel structure to form one or more firewood rack shelves wherein the firewood rack shelves provide, at least in part, structural support of said firewood rack;

an inward facing left channel guide attached to the firewood rack left side panel structure and an inward facing right channel guide attached to the firewood rack right side panel structure; and, a detachable tray interfacing with the inward facing left channel guide and the inward facing right channel guide.

2. The indoor firewood rack of claim 1, wherein the detachable tray is not a structural support element of said firewood rack.

3. The indoor firewood rack of claim 1, wherein the detachable tray comprises a baking sheet.

4. The indoor firewood rack of claim 1, wherein the detachable tray affixed to the bottom of the firewood rack enclosure is configured with a front-to-back pitch.

5. The indoor firewood rack of claim 1, wherein the firewood rack left side panel structure, the firewood rack right side panel structure, and the firewood rack back panel structure comprises, at least in part, wood.

6. The indoor firewood rack of claim 1, wherein at least one or more of the tubular bars comprises, at least in part, lightweight aluminum.

7. The indoor firewood rack of claim 1, wherein the plurality of tubular bars interface with the firewood rack right side panel structure and the firewood rack left side panel structure using one or more star nuts.

8. The indoor firewood rack of claim 1, wherein the firewood rack back panel structure comprises a transparent material.

9. The indoor firewood rack of claim 1, the indoor firewood rack further comprising: one or more detachable liners affixed to the slide-able tray.

10. The indoor firewood rack of claim 9, wherein the one or more detachable liners comprises, at least in part, an insect repellent coated liner.

11. The indoor firewood rack of claim 1, the indoor firewood rack further comprising: a wall mount accessory wherein a one or more components of the wall mount accessory are affixed to the firewood rack back panel structure.

12. The indoor firewood rack of claim 1, the indoor firewood rack further comprising: a cover wherein the cover is releasably securable to a front and top portion of the left side panel structure and right side panel structure of the firewood rack enclosure.

* * * * *